US007703372B1

(12) United States Patent
Shakespeare

(10) Patent No.: US 7,703,372 B1
(45) Date of Patent: Apr. 27, 2010

(54) CLIMBING ROPE

(75) Inventor: William C. Shakespeare, Johnston, RI (US)

(73) Assignee: New England Ropes Corp., Fall River, MA (US)

( * ) Notice: Subject to any disclaimer, the term of this patent is extended or adjusted under 35 U.S.C. 154(b) by 0 days.

(21) Appl. No.: 11/893,066

(22) Filed: Aug. 14, 2007

(51) Int. Cl.
*D04C 1/06* (2006.01)

(52) U.S. Cl. ..... 87/6; 87/9; 87/13

(58) Field of Classification Search ..... 87/6, 87/9, 13

See application file for complete search history.

(56) References Cited

U.S. PATENT DOCUMENTS

| | | | | |
|---|---|---|---|---|
| 2,737,075 | A | 3/1956 | Porier et al. | |
| 3,030,851 | A * | 4/1962 | Meyer | 87/6 |
| 3,035,476 | A | 5/1962 | Fogden | |
| 4,170,921 | A | 10/1979 | Repass | |
| 4,258,608 | A * | 3/1981 | Brown | 87/6 |
| 4,321,854 | A * | 3/1982 | Foote et al. | 87/6 |
| 4,534,163 | A | 8/1985 | Schuerch | |
| 4,640,178 | A | 2/1987 | Kurzbock | |
| 4,640,179 | A | 2/1987 | Cameron | |
| 4,677,818 | A | 7/1987 | Honda et al. | |
| 5,060,549 | A | 10/1991 | Beal | |
| 5,699,657 | A * | 12/1997 | Paulson | 57/22 |
| 5,901,632 | A | 5/1999 | Ryan | |
| 5,931,076 | A | 8/1999 | Ryan | |
| 7,047,860 | B2 | 5/2006 | Faborsky | |
| 7,165,485 | B2 | 1/2007 | Smeets et al. | |
| 2005/0229770 | A1 | 10/2005 | Smeets et al. | |

FOREIGN PATENT DOCUMENTS

| | | |
|---|---|---|
| CA | 2005313 A1 | 6/1991 |
| DE | 7823387 U1 | 11/1978 |
| EP | A-0150702 | 7/1985 |
| FR | 2166695 | 8/1973 |
| FR | A 2166695 | 8/1973 |
| GB | 979206 A | 1/1965 |

OTHER PUBLICATIONS

McKenna, H.A., Hearle W.S., O'Hear, Handbook of fibre rope technology, 2004, Woodhead Publishing, Cambridge.
Anonymous, Trawsteel II Premium Internet Article, Oct. 16, 2006.
Anonymous, IS-II Eye splice instructions, Internet Article 2006.
Anonymous, Yale Cordage Splicing Instructions, internet Article Nov. 28, 2006.

* cited by examiner

*Primary Examiner*—Shaun R Hurley

(57) ABSTRACT

A rope is disclosed that is firm for climbing purposes and in which the end of the rope can be spliced. The rope includes a core of a plurality of strands; a first braided tubular sheath disposed about the core; and a second braided tubular sheath disposed about the first braided tubular sheath. The plurality of strands fill at least a length of a center void formed in the first braided tubular sheath. The plurality of core strands are formed in an un-braided manner in at least one of twisted and non-twisted strands. At the splice the splice tucks fill the center void while the core strands fill only center void outside of the splice.

13 Claims, 8 Drawing Sheets

CLIMBING ROPE

TECHNICAL FIELD

The present invention relates in general to ropes and pertains more particularly to ropes that are used for climbing or arborist ropes.

BACKGROUND OF THE INVENTION

Various rope constructions have been developed over the years in response to market needs for performance improvements. Most notably braided ropes, have substantially replaced the older, more traditional, stranded rope as the preferred construction for many different uses. The innovation in rope products since the introduction of the braided rope has related to the particular materials of the rope.

Increasingly, rope products are designed to meet increasingly more specific performance requirements. These requirements are becoming increasingly more market specific. With respect to one market, arborists, there continue to be a specific and unmet need, which the present invention seeks to meet. That need is the combination of a firm and uniformly shaped rope, and one which is yet easily spliceable. No climbing ropes have, to date, exhibited this mutually exclusive combination of user benefits, namely firm and spliceable.

Arborists' climbing ropes must work precisely in cooperation with commonly used mechanical devices including friction hitches. These hitches and devices require rope firmness and dimensional uniformity to ensure quality-performance. Certain mechanical clearances in channeling a rope through braking devices, for example, may render those devices difficult to operate or even non-functional, if bulges in the rope are present.

In recent years some forms of double braided ropes have been used as climbing ropes due to the ease of splicing these ropes. This represents a compromise in performance because bulges in the rope are commonly exhibited when the rope is used in a braking device or friction hitch. The user is presented with a conflicting choice of an inferior climbing rope which compromises firmness to enable splicing. Firm, uniform arborists' climbing ropes, by virtue of their design, are too tight to enable splicing.

SUMMARY OF THE INVENTION

In accordance with the present invention an improved rope structure is constructed so as to enable both a firm and uniform rope structure, as well as a structure that enables ready splicing of the rope, particularly to form end loops or the like. The climbing rope comprises a core of a plurality of strands; a first braided tubular sheath disposed about the core; and a second braided tubular sheath disposed about the first braided tubular sheath. The plurality of strands substantially completely fill a center void formed by the first braided tubular sheath. The plurality of strands are formed in an un-braided manner in at least one of twisted and non-twisted strands. By the selective removal of a portion of the core by means of forming the rope with a double braid, the rope is partially evacuated at its center to allow space for the bulk from the tucking operation within the splicing process to be buried without substantially affecting the rope's external shape. Because the splice tucks substantially account for the mass of the partially removed core, the rope section, whose core has been removed, retains its firmness by virtue of the fit of the tucks in the defined center space. Also, the remaining section of the rope also has the desired firmness as it retains the center core.

Thus, in accordance with the present invention a superior arborists' climbing rope can be constructed for the user in spliceable form without compromise to its overall performance. The double-braided rope of the present invention contains a concentric core filled with the strands and thus combines the user benefits of firmness and ease in splicing without excessive dimensional irregularity. Important attributes of the present invention include a non-braided core within a double-braided rope; designed-intentional removal of a portion of the core to enable ease in splicing; and substitution of the removed core with splicing tucks.

DESCRIPTION OF THE DRAWINGS

Numerous other features and advantages of the present invention will now become apparent upon a reading of the following detailed description taken in conjunction with the accompanying drawings, in which.

DETAILED DESCRIPTION

Figure 1:
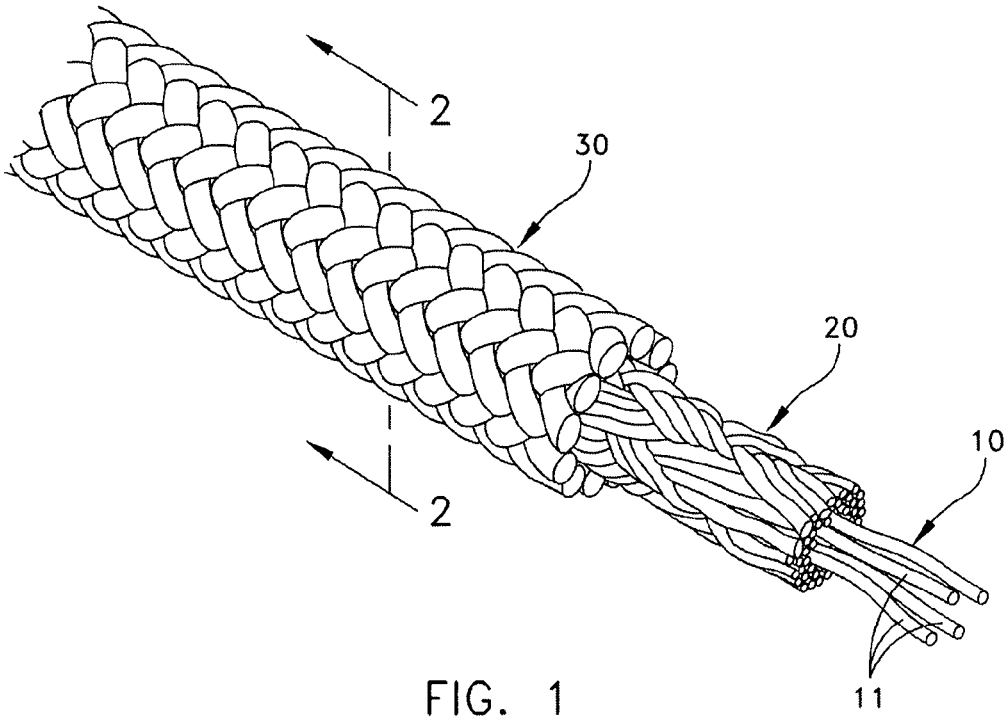
FIG. 1 is a perspective view illustrating one construction of a rope in accordance with the principles of the present invention.
Figure 2:
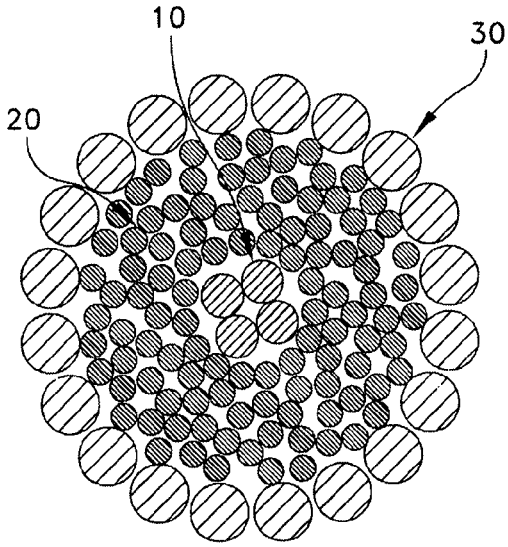
FIG. 2 is a cross-sectional view taken along line 2-2 of FIG. 1.
Figure 4:
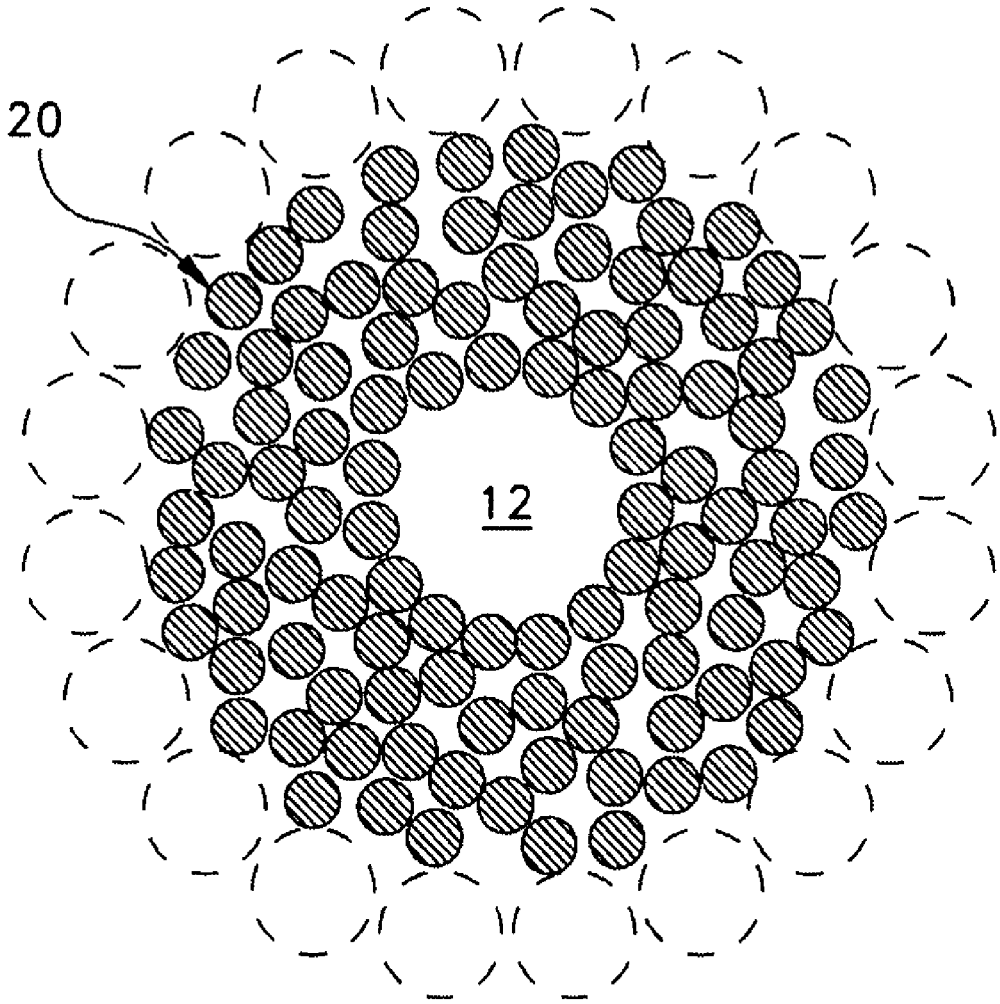
FIG. 4 is a cross-sectional view taken along line 4-4 of FIG. 3.

Reference is now made to the drawings in which FIGS. 1 and 2 illustrate a preferred embodiment of the rope of the present invention. The remaining drawings show a sequence for forming a splice in the rope. The rope illustrated in the drawings is shown as being comprised of a core 10 of a plurality of strands 11, a first braided tubular sheath 20 disposed about the core and a second braided tubular sheath 30 disposed about the first braided tubular sheath 20. The plurality of strands of the core is illustrated as substantially completely filling a center void formed by the first braided tubular sheath 20. Refer to the cross-sectional view of FIG. 4 showing the void at 12. The plurality of strands 11 is preferably formed in an un-braided manner as either twisted or non-twisted strands. By the selective removal of a portion of the core by means of forming the rope with a double braid, the rope is partially evacuated at its center to allow space for the bulk from the tucking operation within the splicing process to be buried without substantially affecting the rope's external shape, as described in further detail later. Because the splice tucks substantially account for the mass of the partially removed core, the rope section, whose core has been removed, retains its firmness by virtue of the fit of the tucks in the defined center space. Also, the remaining section of the rope also has the desired firmness as it retains the center core therein.

The drawings illustrate a low stretch static climbing rope that is spliceable. The diameter of the rope may be on the order of one-half inch or less. It is meant to meet EN1891 standard with a tensile strength that exceeds 6000 lbs. The outer surface of the rope is to be relatively smooth so as to be free running, while also being both abrasion and pick resistant. The rope is to hold knots well and yet be firm so as to not bind up in climbing equipment.

The cover braid 30 may be, for example, a 24 strand construction with one yarn per strand to provide a smooth free running feel to the user. The braid pattern may be 12Z and 12 S strands. The yarns may be, for example, of a twisted polyester for controlled stretch and abrasion resistance. Other types of braids may also be used with other strand patterns and constructions.

The middle braid 20 may be, for example, an 8 strand construction with 4 yarns per strand. The braid pattern may be 4Z and 4 S strands. The middle braid may also be of a twisted polyester. The two braid may be formed with known braiding equipment so that the outer braid is formed over the inner braid. This may be achieved by setting a 16 braider in a tandem configuration and running it in a plain pattern braid. The equipment enables the middle braid to work with the cover braid, while providing a space (see void 12 in FIG. 4) for the core 10. The three element construction maximizes the rope strength and minimizes sheath slippage. The yarns of the middle braid 20 may be a twisted nylon, which helps to provide the stretch desired to reduce the impact force in a fall.

The core itself is illustrated as including four yarns 11. The yarns may be constructed of a twisted multi-filament polypropylene. Fewer or greater numbers of core yarns may be used and they may be in either a twisted or non-twisted form. The twisted multi-filament polypropylene yarn stretches with the other parts of the rope, while firming the rope and both reducing weight and water absorption.

To provide a proper rope construction it has also been found that certain weight ratios are important in providing the desired firmness. The outer cover 30, in one example, has a weight on the order of 52% of the total weight of the rope. The middle braid 20, in the example has a weight on the order of 44% of the total weight of the rope. The core 10, in the example has a weight on the order of 4% of the total weight of the rope. The preferred range of weight of the core 10 is 2-6% of the total weight. The core volume is preferably in a range of 12-15% of the total rope volume, but may be in a range up to 10-20% of the total volume of the rope.

The following are the steps taken in performing a splicing operation. These steps are merely illustrative of one way of performing a splicing operation, it being understood that there may be many other splicing techniques that can be practiced with the concepts of the present invention. In each case the center core is removed at the area of the splice so that the splice tucks are essentially substituted for the removed core material. The following are the steps using measurements for 7/16" rope for all marks. Use a small (or 5/16) fid when splicing.

STEP 1

From the end of the rope measure back one full fid length (refer to a Fid Measurement Table) and make Mark "A".

Figure 3:
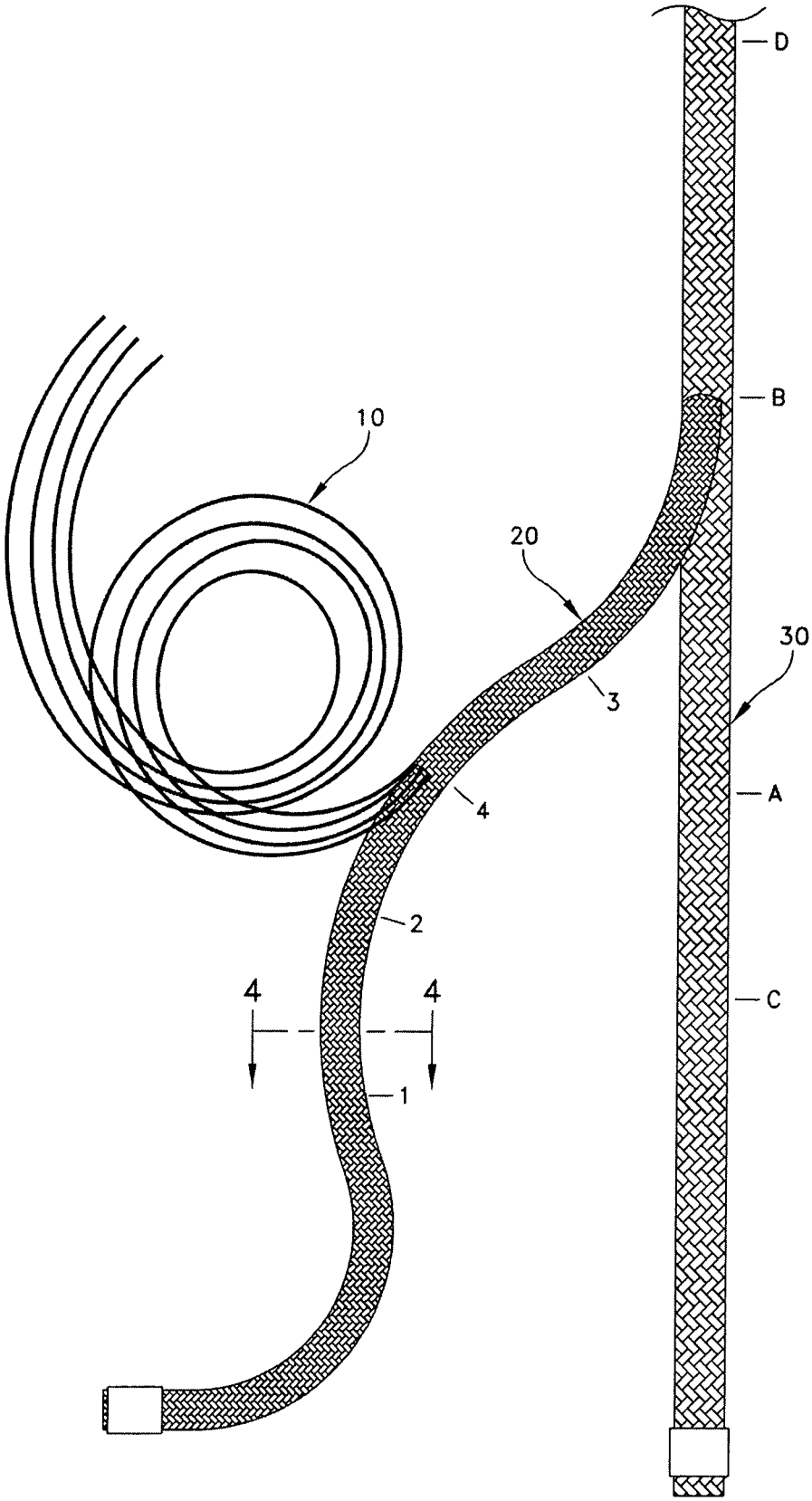
FIG. 3 is a schematic view of a first step taken in constructing a splice in the rope.

Using Mark "A" as a reference, form the desired size eye and make Mark "B" on the rope directly opposite Mark "A" as shown in, for example, FIG. 3.

From Mark "B" measure one long fid section (down the body of rope) and make Mark "D".

Figure 8:
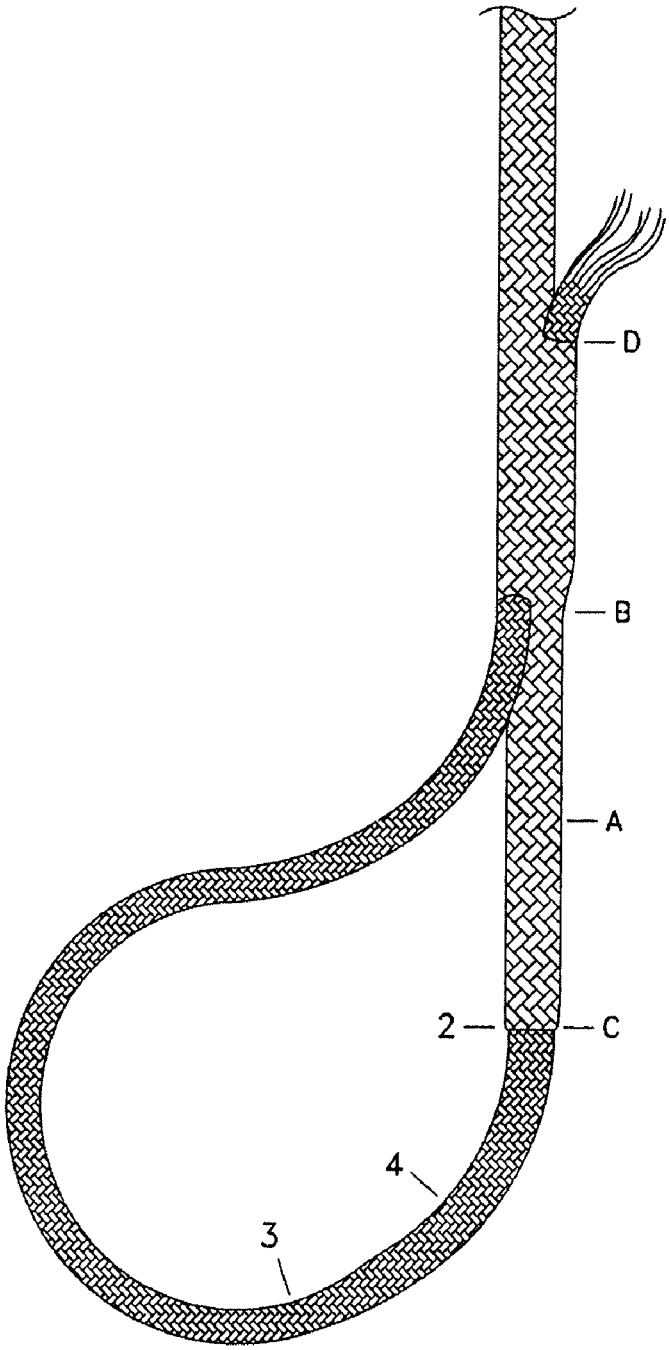

From Mark "D" measure down the rope approximately 5 full fid lengths and tie a slip knot or FIG. 8 knot in the rope.

From Mark "A" measure ½ a short fid length toward the end of the rope and make a heavy mark completely around the rope. This is Mark "C".

From Mark "C" count nine consecutive left or right strands toward the end of the rope and mark the 9th left and right strand pair. From this point count another four consecutive strands and mark the 4th strand pair. Count another five consecutive strands and mark the 5th strand pair. Continue counting and marking in this 4:5 sequence to the end of the rope.

STEP 2

Bend the rope sharply at Mark "B" and carefully spread the cover strands to expose the core. Pry the core braid out from the cover. Use care to avoid pulling any strands. Pull the end of the core braid completely out of the cover. Tightly tape the end of both the cover and core braids. Holding the exposed core, slide the cover braid back to the knot. Then hold the knot and slide the slack cover back down the core in the direction of the end of the rope until all of the slack has bee removed. Mark the core at that point where it exits from the cover. This is Mark "1". Once again slide the cover toward the knot. Measure one short fid length (see "Fid Measurement Chart") from Mark "1", toward the knot and make two marks that go completely around the core. This is Mark "2".

From Mark "2" measure one full fid length plus a short fid length toward the knot and make three marks completely around the core. This is Mark "3". From Mark "2" measure a short fid length toward the knot and make a mark as this is Mark "4".

STEP 3

Open the core braid at Mark "4" and pull the ends of the four blue inner strands out of the core braid. Refer to FIG. 3

STEP 4

Figure 5:
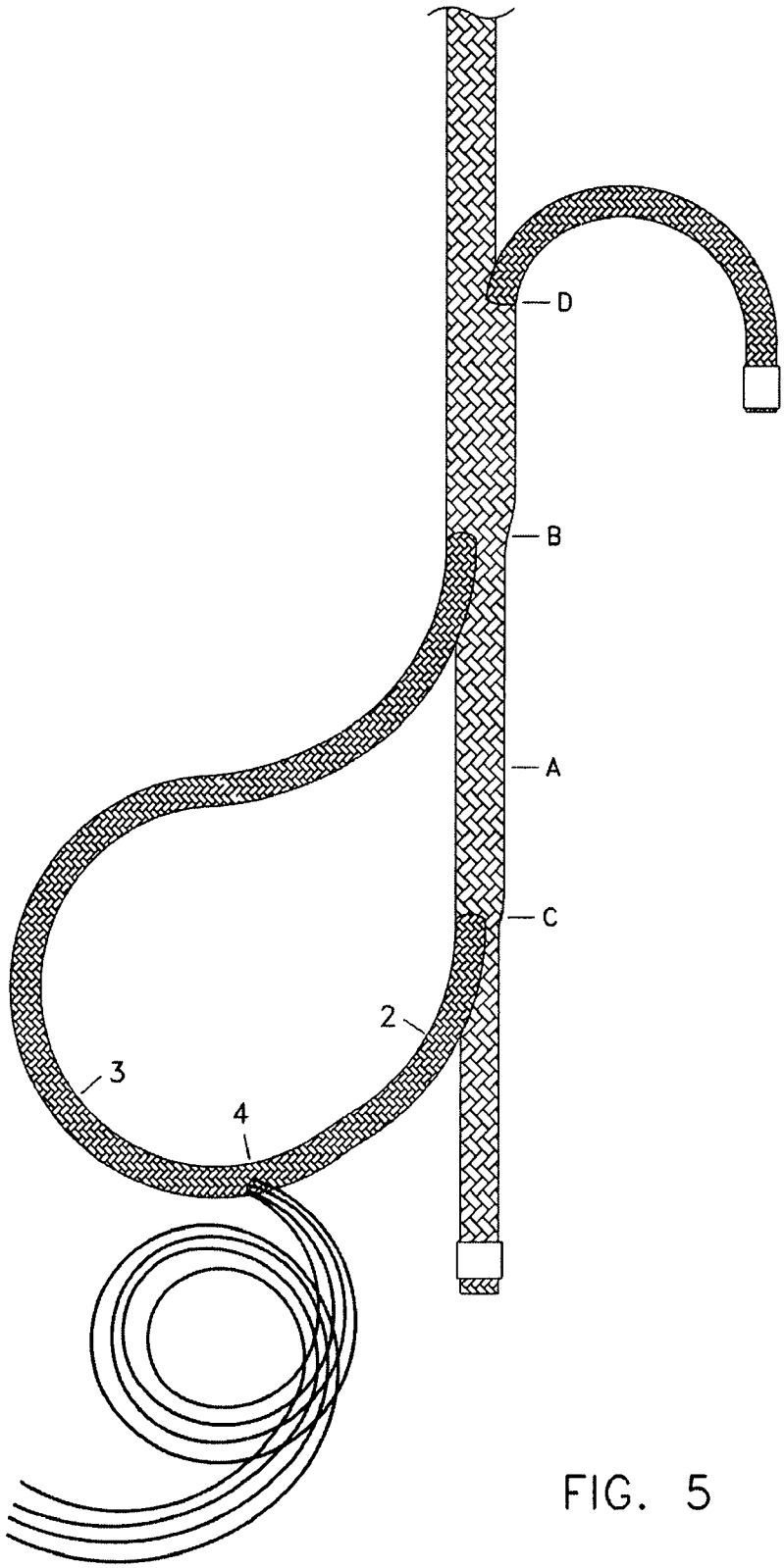
FIGS. 5, 6 and 8 are successive schematic view of further steps taken in constructing the splice in the rope.

Using masking tape place a wrap of tape (2") on the end of the core tail. Taper this by cutting the end at a 45 degree angle. Attach fid and insert the fid into the cover at Mark "C" and out at Mark "D". When exiting or entering the braid with the fid always go between strands. The rope may be extremely tight where the fid is traveling between Marks "C" and "D". To create more space in this area, grasp the core as it exists the cover at point "B" and pull extra core out of the rope. This will cause the cover to "pucker" and give you some extra space. If the distance between "C" and "D" is longer than the length of the fid, hold the fid in place by squeezing it through the cover braid. Slide the cover slack back from the fid to Mark "C" to draw the core tail into the cover. Then continue working the fid through the cover to Mark "D". Repeat as necessary. Avoid snagging the core with the tip of the fid when it is passing through the cover in the vicinity of Mark "B". To check if the core has been snagged, pull on the exposed core where it exists from the cover at Mark "B". If the core moves freely it is OK to proceed. If the core appears to be stuck, pull the Uni-Fid back until the core is no longer snagged and continue. Refer to FIG. 5

STEP 5

Cut and remove the marked strand pairs on the cover tail, working toward the end of the cover tail.

STEP 6

Using masking tape place a wrap of tape (2") on the end of the cover tail. Taper this by cutting the end at a 45 degree angel. Attach the fid to the cover and tape the tapered point to the fid. Insert the fid into the hollow core at Mark "2" and out at Mark "3". Remove the fid and tape. Notice the loop at mark "C" after running the cover through the core. To remove this loop simply pull on the core exiting mark "D" until the loop disappears. (Marks "2" and "C" align).

STEP 7

Figure 6:
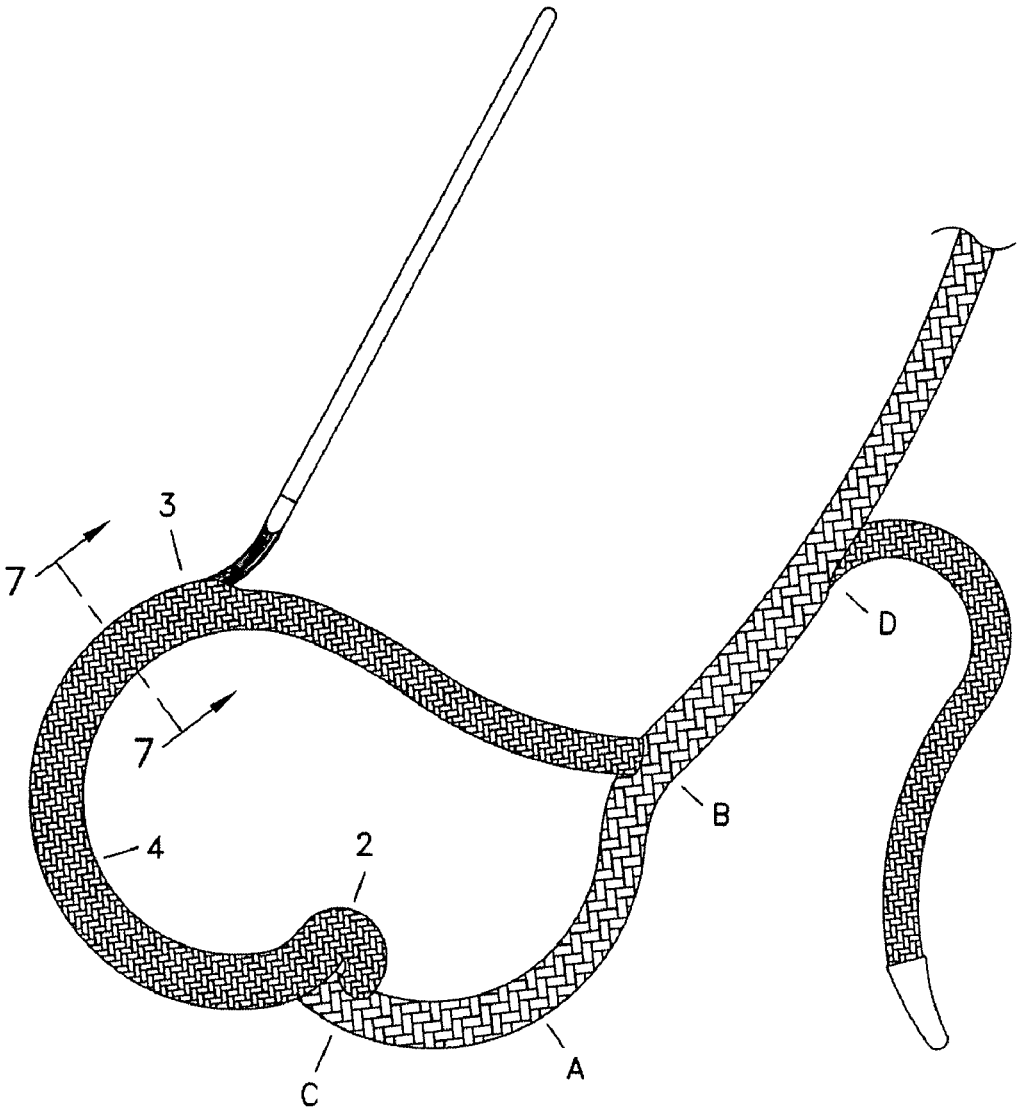

The crossover is the point where Mark 'C" on the cover and Mark "2" on the core meet. To tighten, hold the rope at the crossover point and alternately pull on the free ends of the cover and core. Continue this process until the crossover is approximately the same diameter as the rope. Refer to FIG. 6

STEP 8

This involves burying the various tails. To bury the cover tail, hold the rope at the crossover and smooth the core toward the cover tail, which will disappear. For inner blue strands, cut off where they exit at mark "4". To bury the core tail, hold the crossover and smooth out the slack in the cover braid from the crossover down to Mark "D". Repeat this process several times to remove all cover slack. Most of the core will disappear; however, some of the core tail will still remain at mark "D" after this process. Mark the core tail where it exits from the cover at the Mark "D". Then mark the core tail at Mark "B" by inserting the marking pen into the opening at Mark "B". Pull out the core tail at Mark "D" until the mark made at "B" appears (approx. a long fid length). Cut off the excess core tail at the first mark (the one nearest the end of the core) and unbraid the core tail back to the second mark. Fan out the strands. Cut the strands at a 45 degree angle starting at a point about halfway back from the end (between the two marks). Again, hold the rope at the crossover and smooth the cover braid from the crossover toward Mark "D". The exposed core will disappear completely inside the cover. Refer to FIG. 8.

STEP 9

Secure the knot tied in the body of the rope to a solid anchor point. Since a good deal of tension may be placed on the rope when burying the splice, the anchor point should be very sturdy. The slack in the cover braid between the knot and Mark "B" will be used to bury the exposed core, crossover and cover down to Mark "A" to produce the desired size eye. This is accomplished by holding the rope at the top of the eye and sliding the cover slack back from the knot towards the splice. Milk the cover from the crossover around the radius of the eye to the throat at "B" and the pull that leg sharply with a spike to help seat the space. Flex and/or hammer the splice section to loosen the fibers. If insufficient tension is placed on the rope while milking up the slack the crossover may tend to bunch up. If this happens, slid the cover slack back toward the knot until the crossover is the proper size. Then repeat the milking procedure.

STEP 10

Figure 9:
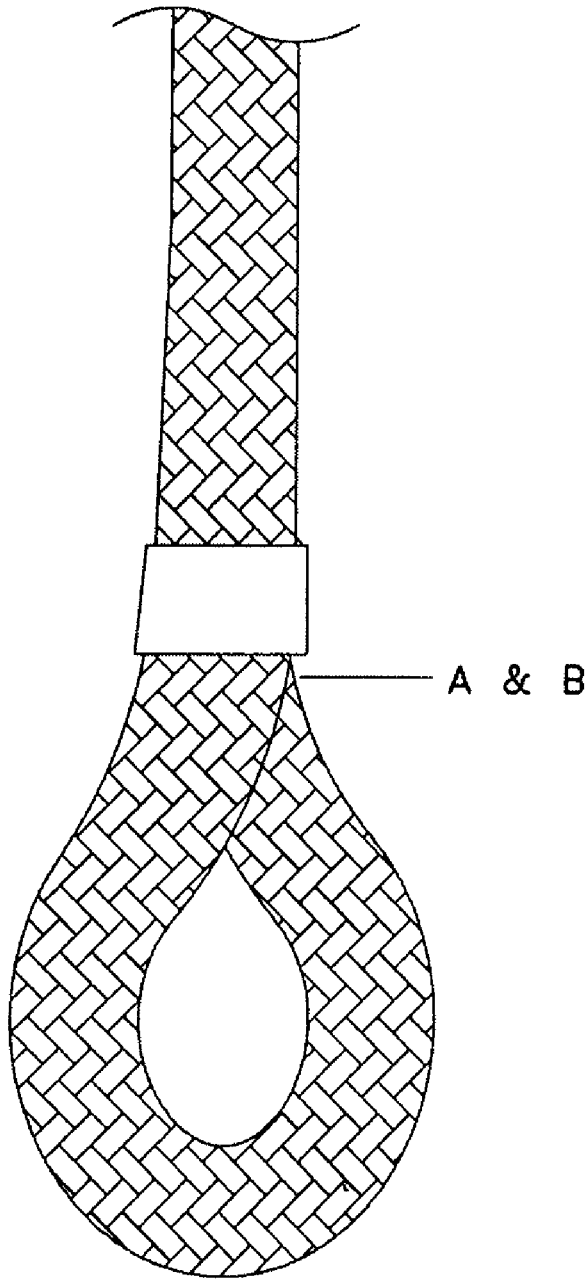
FIG. 9 illustrates the final rope splice.

Lock Stitch and Whip to complete the splice. Refer to FIG. 9

Figure 7:
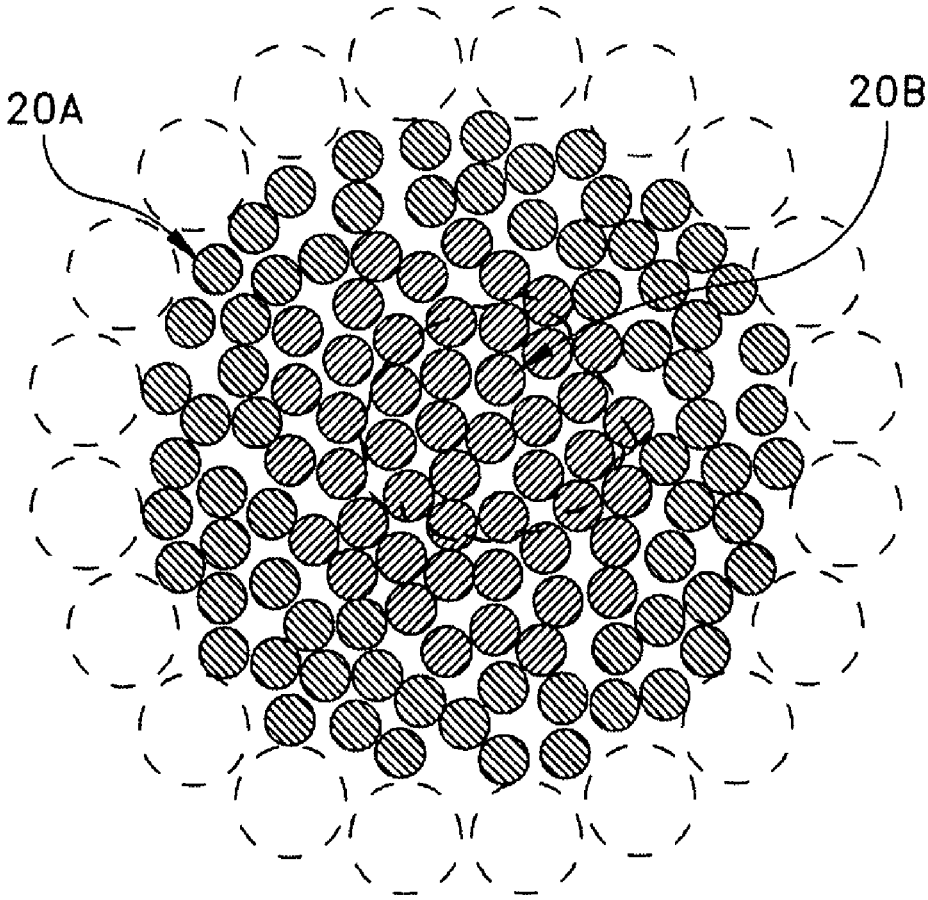
FIG. 7 is a cross-sectional view taken at line 7-7 of FIG. 6 showing the splicing tucks.

Reference is now made to FIG. 7 which is a cross-sectional view taken at line 7-7 of FIG. 6 showing the splicing tucks 20B that fill the center void area 12 within the middle braid indicated at 20A. This occurs during the splicing operation so that the splice remains firm. Outside of the splice area the center void is filled with the center core material as described before.

Having now described a limited number of embodiments of the present invention it should now be apparent to those skilled in the art that numerous other embodiments and modifications thereof are contemplated as falling within the scope of the present invention. For example, various types of braid constructions can be used and various types of braiding equipment can be used in forming the rope of this invention. Various types of splicing techniques can be employed, as long as the splicing tucks are used to fill the formed void at the splice.

What is claimed is:

1. An arborist's climbing rope comprising:

(a) a core constructed of a plurality of strands of twisted multi-filament polypropylene;

(b) a first braided tubular sheath constructed of a plurality of strands of a twisted polyester disposed about the core; and (c) a second braided tubular sheath constructed of a plurality of strands of a twisted polyester disposed about the first braided tubular sheath.

2. The arborist's climbing rope of claim 1 wherein the first braided tubular sheath comprises an 8 strand construction with 4 yarns per strand.

3. The climbing rope of claim 2 wherein the first braid pattern in the first braided tubular sheath is 4Z and 4 S strands.

4. The arborist's climbing rope of claim 1 wherein the second braided tubular sheath has a 24 strand construction with one yarn per strand, to provide a smooth free running feel to the user.

5. The arborist's climbing rope of claim 4 wherein the braid pattern in the second braided tubular sheath is 12Z and 12 S strands.

6. The arborist's climbing rope of claim 1 wherein the weight of the core is on the order of 4% of the total weight of the climbing rope, the first braided tubular sheath has a weight on the order of 44% of the total weight of the climbing rope and the second braided tubular sheath has a weight on the order of 52% of the total weight of the climbing rope.

7. The arborist's climbing rope of claim 6 wherein the core volume is in a range of 12-15% of the total rope volume.

8. An arborist's climbing rope having an eye splice near one end, said eye splice including a splice tuck, said arborist's climbing rope comprising:

(a) a core of a plurality of strands;

(b) a first braided tubular sheath disposed about the core; and (c) a second braided tubular sheath disposed about the first braided tubular sheath;

(d) a portion of the core being intentionally removed near the eye splice to form a space within the first tubular sheath where the core has been removed;

(e) the splice tuck being buried in and substantially completely filling the space within the first tubular sheath where the core has been intentionally removed to provide an arborist's climbing rope that is firm even where the portion of the core has been removed and wherein the external shape of the arborist's climbing rope is not substantially affected.

9. An arborist's climbing rope having an eye splice near one end, said eye splice including a splice tuck, said arborist's climbing rope comprising:

(a) a core of a plurality of strands of twisted multi-filament polypropylene;

(b) a first braided tubular sheath constructed of a plurality of strands of twisted polyester disposed about the core: and (c) a second braided tubular sheath disposed about the first braided tubular sheath;

(d) a portion of the core being intentionally removed near the eye splice to form a space within the first tubular sheath where the core has been removed;

(e) the splice tuck being buried in and substantially completely filling the space within the first tubular sheath where the core has been intentionally removed to provide an arborist's climbing rope that is firm even where the portion of the core has been removed and wherein the external shape of the arborist's climbing rope is not substantially affected.

10. The arborist's climbing rope of claim 9 wherein the first braided sheath comprises an 8 strand construction with 4 yarns per strand.

11. The arborist's climbing rope of claim 10 wherein the second braided sheath is constructed of a plurality of strands of a twisted polyester.

12. The arborist's climbing rope of claim 11 wherein the core has a weight on the order of 4% of the total weight of the climbing rope, the first braided tubular sheath has a weight on the order of 44% of the total weight of the climbing rope and the second braided tubular sheath has a weight on the order of 52% of the total weight of the climbing rope.

13. An arborist's climbing rope comprising a core of a plurality of twisted strands of polypropylene, a first braided tubular sheath constructed of a plurality of strands of material selected from the group consisting of twisted polyester and nylon disposed about the core and a second braided tubular sheath constructed of a plurality of strands of a polyester disposed about the first braided tubular sheath, the arborist's climbing rope having a diameter on the order of one-half inch or less and having a tensile strength that exceeds 6000 pounds.

* * * * *